US006871800B2

(12) United States Patent
Tinwell et al.

(10) Patent No.: US 6,871,800 B2
(45) Date of Patent: Mar. 29, 2005

(54) FUEL INJECTOR

(75) Inventors: Paul Tinwell, Northwich (GB); John Anthony Burrows, Northwich (GB)

(73) Assignee: Federal-Mogul Ignition (U.K.) Limited, Merseyside (GB)

( * ) Notice: Subject to any disclaimer, the term of this patent is extended or adjusted under 35 U.S.C. 154(b) by 224 days.

(21) Appl. No.: 10/221,422

(22) PCT Filed: Mar. 9, 2001

(86) PCT No.: PCT/GB01/01023

§ 371 (c)(1),
(2), (4) Date: Sep. 10, 2002

(87) PCT Pub. No.: WO01/66935

PCT Pub. Date: Sep. 13, 2001

(65) Prior Publication Data

US 2003/0047625 A1 Mar. 13, 2003

(30) Foreign Application Priority Data

Mar. 10, 2000 (GB) ..... 0005744

(51) Int. Cl.[7] ..... F02M 59/00; F02M 39/00; B05B 1/30

(52) U.S. Cl. ..... 239/533.2; 239/533.3; 239/533.4; 239/533.8; 239/533.9; 239/585.5; 239/585.1

(58) Field of Search ..... 239/533.2, 533.3, 239/533.4, 533.7, 533.8, 533.9, 585.1–585.5, 88–93, 95, 569, 900; 251/129.15, 129.21, 127

(56) References Cited

U.S. PATENT DOCUMENTS

| | | | | |
|---|---|---|---|---|
| 4,048,971 A | | 9/1977 | Pritchett | |
| 4,466,571 A | | 8/1984 | Muhlbauer | |
| 4,467,963 A | * | 8/1984 | Sisson et al. | 239/90 |
| 4,503,825 A | * | 3/1985 | Schneider | 123/446 |
| 5,020,498 A | | 6/1991 | Linder et al. | |
| 5,397,055 A | * | 3/1995 | Paul et al. | 239/124 |
| 5,540,206 A | | 7/1996 | Heimberg | |
| 5,636,615 A | * | 6/1997 | Shorey et al. | 123/506 |
| 5,890,662 A | | 4/1999 | Dykstra | |

FOREIGN PATENT DOCUMENTS

| | | |
|---|---|---|
| DE | 2751457 | 11/1977 |
| DE | 4107622 | 9/1991 |
| DE | 19528807 | 8/1995 |
| GB | 336769 | 9/1929 |
| GB | 499040 | 6/1937 |
| WO | WO 96/34196 | 4/1996 |

* cited by examiner

*Primary Examiner*—David Hwu
(74) *Attorney, Agent, or Firm*—Reising, Ethington, Barnes, Kisselle, P.C.

(57) ABSTRACT

A fuel injector (10; 100) comprises an inlet (60) from which fuel can be transferred into a cavity (61) of the injector, at least one outlet orifice (86) communicating with said cavity (61), and ejecting means (44, 88) operable to apply force to fuel in said cavity to cause said fuel to be ejected through said orifice as discreet charges at pre-determined intervals. The operation of said ejecting means (44, 88) is also operable to transfer further fuel into said cavity (61).

15 Claims, 2 Drawing Sheets

FUEL INJECTOR

This invention is concerned with a fuel injector operable to inject charges of atomised fuel into the inlet manifold of an internal combustion engine.

Fuel injectors are commonly used in engines for cars and other road vehicles. These injectors usually comprise a high pressure pump to supply fuel under high pressure to valves located adjacent each of the combustion chambers of the engine. The valves are operated by solenoids which are energised to open the valves when a fuel charge is required. This type of fuel injector can operate at very high speeds to ensure that fuel charges are delivered when required. This type of injector is suitable for microprocessor control in an engine management system. However, because of the high manufacturing accuracy and consequent high cost of the injectors and the associated pump, this type of fuelling system is generally too expensive for use on small engines such as the one cylinder engines used for lawn-mowers and relatively slowly-running engines for small boats etc. Such engines presently use carburettors but carburettors are not easily adapted to microprocessor control necessary for engine management systems needed to reduce harmful emissions and to increase fuel economy.

It is an object of the present invention to provide a fuel injector which is sufficiently cheap to enable it to be used in small engines but which is suitable for microprocessor control.

The invention provides a fuel injector which comprises an inlet for fuel from which fuel can be transferred into a cavity of the injector, at least one outlet orifice communicating with said cavity, and ejecting means operable to apply force to fuel in said cavity to cause said fuel to be ejected through said orifice as discrete charges at predetermined intervals, characterised in that the operation of said ejecting means is also operable to transfer further fuel into said cavity.

In an injector according to the invention, the force required to eject the charges of fuel is generated in the injector while the ejecting means also serves the function of transferring the fuel into the cavity from which it is ejected. These provisions avoid the necessity for a high pressure pump and result in a cheap injector. The fuel may be transferred to the cavity by having force applied directly thereto by a piston of the ejecting means or the fuel may be pressurised so that movement of the piston allows the fuel to enter the cavity.

Said ejecting means may be operable to move a piston to apply force to fuel in said cavity and said further fuel may be transferred to said cavity through a passage through said piston, said passage containing a one-way valve. Said one-way valve is, preferably mounted at a force-applying end of the piston. The movement of said piston may also be effective to draw fuel in through said inlet. The ejecting means may comprise an electromagnetic coil and said piston be made of soft-magnetic material. The use of an electromagnetic coil enables the operation of the injector to be controlled in a simple manner. For example, variation of the electric current supplied to the coil can be varied to give an increasing magnetic force with increasing stroke. Thus, where a spring is used to move the piston in the opposite direction, the magnetic force can be varied to give a linear relationship to the resultant force experienced by the piston, ie the magnetic force increases to counteract the increasing force applied by the spring as the spring is compressed. This has the advantage of making calibration of the injector much simpler and facilitates feedback of the piston location (if required) to the control system. Furthermore, the electric current supplied to the coil can be varied, as the piston approaches the end of its stroke, to cushion any impact between the piston and other parts of the injector, thereby avoiding the necessity for cushioning means or additional clearance.

Preferably, where the ejecting means of the injector comprises a piston which applies the force to the fuel, the injector is arranged so that diameter of the force-applying end of the piston has a small ratio to the stroke of the piston, ie the diameter at the force applying end of the piston and the stroke are approximately equal, eg in a range between 1:2 and 2:1. This increases the accuracy of delivery, reduces leakage, and reduces the piston mass required. A reduced piston mass improves overall efficiency, reduces the size of electromagnetic coil (and hence the coil's inductance), reduces the size of the spring required and facilitates rapid operation. It is advantageous if the electromagnetic coil is utilised to compress the spring, thereby storing energy in the spring, and the spring is used to apply the ejecting force to the fuel. In this way, the energy stored can be carefully controlled by control of the current applied to the coil and the spring can deliver the high impact force required for atomisation.

Although from the force-applying point of view the piston should have a small diameter, it requires a larger diameter to enable it to be moved rapidly and accurately by the electromagnetic coil. This is resolved by use of a stepped piston having an increased diameter portion within the electromagnetic coil and a reduced diameter portion which is a close fit in a cylindrical passage.

Preferably, the dead volume at the end of the piston stroke is kept as small as possible (a clearance of 0.1 mm can be achieved). Reduction of the dead volume facilitates self evacuation of the injector, ie the removal of air or other gas on start-up and during operation, since nearly the entire volume ahead of the piston is swept in a single stroke. The dead volume can be reduced by use of a small diameter piston, by positioning the one-way valve carried by the piston as near as possible to the outlet, and by utilising one-way valves which do not have a return spring (thereby saving the volume required by a spring).

There now follow detailed descriptions, to be read with reference to the accompanying drawings, of two fuel injectors which are illustrative of the invention. In the detailed descriptions, references to "upwards" and "downwards" and words with similar meanings refer to directions in the drawings since the injectors could be mounted in different orientations to those shown in the drawings.

Figure 1:
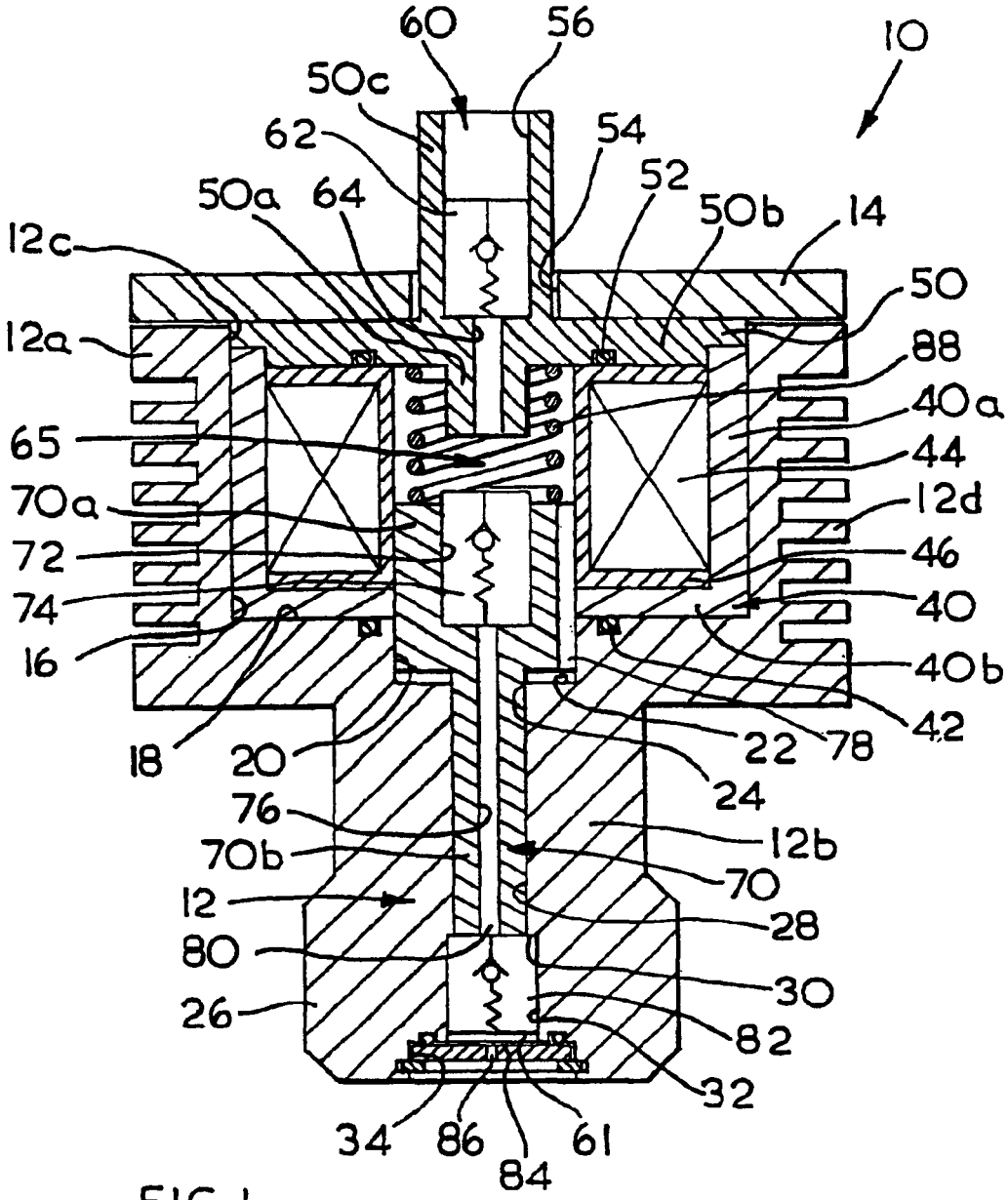
FIG. 1 is a vertical cross-sectional view taken through the first illustrative fuel injector.

The first illustrative fuel injector 10 shown in FIG. 1 comprises a nonmagnetic housing 12 which is designed to be mounted in an internal combustion engine. The housing 12 comprises a hollow cylindrical upper portion 12*a* and a hollow cylindrical portion 12*b*. The portions 12*a* and 12*b* of the housing are integral with one another and co-axial. The upper portion 12*a* has a greater diameter than the lower portion 12*b* and has an opening 12*c* at its upper end. A lid 14 of the injector 10 is arranged to close the opening 12*c* by being bolted to the housing portion 12*a* by bolts (not shown). The outer cylindrical surface of the upper portion 12*a* is provided with cooling fins 12*d* which extend circumferentially around the housing portion 12*a*. The space within the upper housing portion 12*a* is bounded by surfaces 16, 18, 20 and 22. The surface 16 is cylindrical and extends downwardly from the opening 12*c* at the top of the housing 12. At its lower end, the surface 16 has a junction with a surface 18 which is annular, upwardly facing, and extends radially inwardly to a junction with the surface 20 which is cylindrical and extends downwardly from its junction with the surface 18 to a junction with the surface 22. The surface 22 is a further annular surface which defines a downwardly-facing lower opening 24 of the housing portion 12*a*. The surfaces 16 and 20 and the openings 12*c* and 24 are all co-axial.

The lower housing portion 12*b* has an external screw-threaded fitting 26 by means of which the injector 10 can be mounted in an internal combustion engine.

The lower housing portion 12 also has an internal cylindrical surface 28 which extends downwardly from the opening 24 of the housing portion 12*a* to a junction with an annular surface 30. The annular surface 30 extends radially outwardly to a junction with a cylindrical surface 32 of the housing portion 12*b*. The surface 32 extends downwardly to enter a recess 34 which opens into a lower surface of the lower housing portion 12*b*. The surfaces 28 and 32 are coaxial with the aforementioned surfaces 16 and 20 of the upper housing portion 12*a*.

The injector 10 also comprises a magnetic core 40 which is housed within the space defined by the surface 16 of the upper housing portion 12*a*. The magnetic core 40 is made of soft-magnetic material. The magnetic core 40 has an upper hollow cylindrical portion 40*a* which, fits snugly inside the surface 16, and an annular lower portion 40*b* which is integral with the portion 40*a* and extends inwardly from the lower end of the portion 40*a*. The lower portion 40*b* rests on the surface 18 and has a central opening therethrough which is of the same diameter as the surface 20. A sealing ring 42 is provided in a recess of the surface 18 to create a seal between the magnetic core 40 and the upper housing portion 12*a*.

The injector 10 also comprises an electromagnetic coil 44 which is in the form of a hollow cylinder which is mounted within the magnetic core 40. The coil 44 is wound onto a bobbin 46 which extends across the inner surface of the coil 44 and also across both the upper and lower annular surfaces of the coil 44. The bobbin 46 is made of non-magnetic thermally-conductive material. The internal diameter of the bobbin 46 is the same as the diameter of the surface 20. Specifically, the outer surface of the coil 44 fits snugly within the hollow cylindrical upper portion 40*a* of the core 40 and the bobbin 46 rests on top of the annular portion 40*b* of the magnetic core 40.

The injector 10 also comprises an inlet 60 from which fuel can be transferred into a cavity 61 of the injector 10. The inlet 60 is defined by an inlet-defining member 50 which also serves as a closure plate for the magnetic core 40. The member 50 is made of soft-magnetic material. Specifically, the member 50 comprises a hollow cylindrical lower portion 50*a* which projects downwardly into the space within the bobbin 46. The member 50 also comprises a central annular portion 50*b* which projects outwardly from the portion 50*a* beneath the lid 14 to cover the top surface of the bobbin 46 and to form a stepped junction with the cylindrical portion 40*a* of the magnetic core 40. A sealing ring 52 in a groove in the portion 50*b* of the member 50 creates a seal between the member 50 and the bobbin 46. The central portion 50*b* of the member 50 combines with the core 40 in forming a magnetic flux guide for the coil 44.

The member 50 also comprises an upper hollow cylindrical portion 50*c* which extends upwardly through a central aperture 54 in the lid 14. The hollow cylindrical portions 50*a* and 50*c* of the member 50 are co-axial with the surface 28 of the lower housing portion 12*b*. The portion 50*c* has a hollow interior bounded by a cylindrical surface 56 which extends downwardly from an opening in the top of the portion 50*c*. This opening provides the inlet 60 of the injector 10. The space defined by the surface 56 contains a one-way valve 62 arranged so that liquid can pass downwardly from the inlet 60 to a passage 64. The passage 64 communicates with the space defined by the surface 56 and passes through the portions 50*b* and 50*a* to enter a space 65 which is defined within the bobbin 46. Liquid cannot, however, pass upwardly through the valve 62 towards the inlet 60.

The injector 10 also comprises a piston 70 made of soft-magnetic material. The piston 70 comprises an upper hollow cylindrical portion 70*a* which is housed within the upper housing portion 12*a*. The portion 70*a* is slidable axially within the housing portion 12*a*. The sliding motion of the piston 70 downwardly is limited by engagement by the lower surface of the piston portion 70*a* with the annular surface 22. The upper piston portion 70*a* is arranged so that it is within the magnetic field created by the coil 44 to be moved thereby. The field acts between the portion 50*b* of the member 50 and the portion 40*b* of the core 40. The piston portion 70*a* defines a recess 72 which opens through the upper surface of the piston portion 70*a*. The recess 72 contains a one-way valve 74 which communicates with the space 65 beneath the lower portion 50*a* of the member 50 and within the bobbin 46. The valve 74 is arranged so that liquid can pass downwardly through the valve 74 from the space 65 to enter a passage 76 which extends downwardly though the piston portion 70*a* from the recess 72. The outer cylindrical surface of the piston portion 70*a* is provided with a groove 78 which extends longitudinally throughout the length of the piston portion 70*a*. The groove 78 has the purpose of providing an escape for liquid which would otherwise be trapped between the surface 22 and the upper piston portion 70*a*.

The piston 70 also comprises a lower hollow cylindrical portion 70*b* of smaller diameter than the piston portion 70*a*. The piston portion 70*b* is arranged to apply force to the fuel in the cavity 61 to cause it to be ejected. Specifically, a lower end portion of the piston portion 70*b* impacts on the fuel. The portion 70*b* is guided by the surface 24 of the lower housing portion 12*b* and is a close fit therein. The portion 70*b* is integral with the portion 70*a* and extends downwardly therefrom through the opening 24 into the space bounded by the surface 28. The passage 76 extends right through the lower piston portion 70*b* to an opening 80 in the lower surface thereof. Beneath the opening 80, a one-way valve 82 is housed within the space defined by the surface 32. The valve 82 is arranged so that liquid can pass downwardly therethrough from the opening 80 into the recess 34 but liquid cannot pass in the other direction. The recess 34 has an orifice plate 84 mounted therein such as liquid can only pass out of the recess 34 through an orifice 86 in the orifice plate 84. The orifice 86 provides an outlet of the injector 10. The aforementioned cavity 61 is formed between the lower surface of the one-way valve 82 which, therefore, bounds the cavity 61, and the upper surface of the plate 84. The cavity 61 communicates with the orifice 86.

The injector 10 also comprises a return spring 88, specifically a coil spring, which acts to press the piston 70 downwardly. The spring 88 is housed in the space 65 and acts between the upper surface of the upper piston portion 70*a* and the lower surface of the central portion 50*b* of the member 50.

In the operation of the first illustrative injector 10, the electromagnetic coil 44 is energised under the control of a processing unit (not shown) to move the piston 70 upwardly against the force of the spring 88. This compresses the spring 88 so that, when the coil 44 is de-energised, the spring 88 causes the piston 70 to move rapidly downwardly. During such downward movement of the piston 70, liquid contained in the passage 76, in the space defined by the surface 28 beneath the lower piston portion 70*b*, in the non-return valve 82, and in the cavity 61 is forced downwardly and a pre-determined portion of the liquid is violently ejected through the orifice 86. This causes the liquid passing through the orifice 86 to be atomised into droplets which travel into the combustion chamber of the internal combustion engine. The liquid has to pass through the orifice 86 since it is prevented from escaping upwardly by the one-way valve 74. Any liquid contained in the space between the surface 22 and the upper piston portion 70*a* escapes through the groove 78. Simultaneously, during the downward movement of the piston 70, liquid is sucked into the space 65 from the inlet 60 through the one-way valve 62 and the passage 64. In FIG. 1, the piston 70 is shown in the position which corresponds to it having completed its downward movement under the action of the spring 88.

When the coil 44 is energised, the piston 70 is, as aforementioned, moved upwardly against the force of the spring 88. This movement causes liquid in the space 65 to be forced through the one-way valve 74 into the passage 76. The liquid cannot escape upwardly to the inlet 60 because of the one-way valve 62.

It will be apparent that energising the coil 44 caused the piston 70 to move away from the orifice 86. The distance travelled by the piston 70, and therefore the quantity of liquid delivered through the orifice 86 when the coil is de-energised, can be controlled by the duration of the energisation of the coil 44 and the frequency of the energisation of the coil 44 determines the frequency of the charges of liquid which are delivered through the orifice 86. The liquid fuel is delivered by gravity or by low pressure pump to the inlet 60 and is delivered as a series of atomised charges to the combustion chamber from the orifice 86.

It will also be apparent that the coil 44 and the spring 88 of the injector 10 together form ejecting means operable to move the piston 70 to apply force to fuel in the cavity 61 to cause said fuel to be ejected through the orifice 86 as discreet charges at pre-determined intervals. Furthermore, the operation of the coil 44 and the spring 88 causes further fuel to be transferred in to the cavity 61, the further fuel passing from the space 65 through the piston 70 as the piston moves upwardly.

Figure 2:
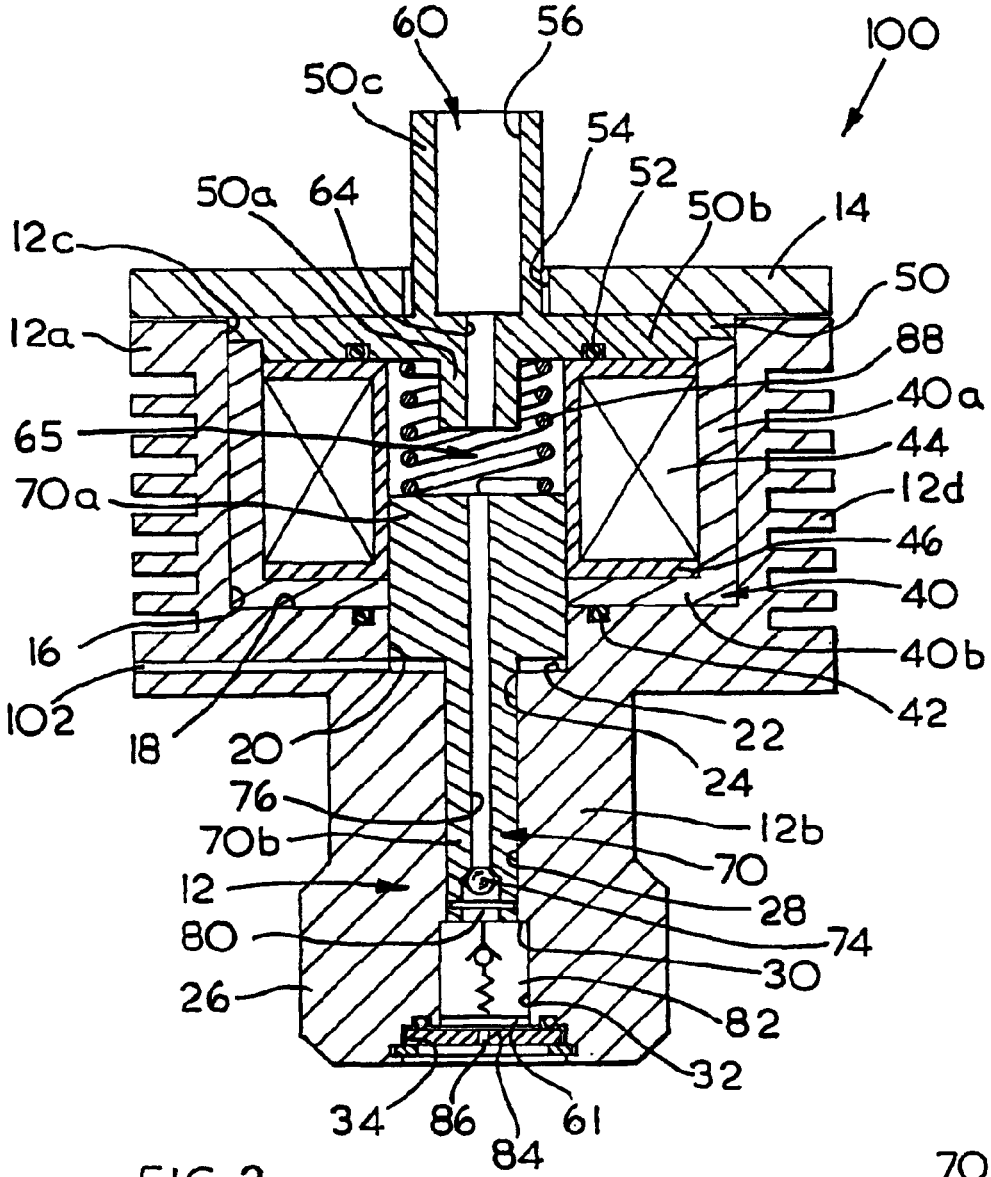
FIG. 2 is a view similar to FIG. 1 but shows the second illustrative fuel injector.
Figure 3:
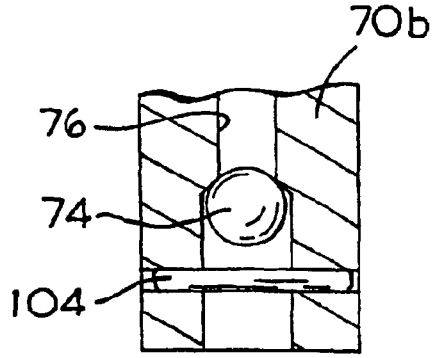
FIG. 3 is an enlarged view of a portion of FIG. 2.

The second illustrative fuel injector 100 shown in FIGS. 2 and 3 is generally similar to the fuel injector 10, differing as explained hereinafter, and the same reference numerals are used for like parts without repeating the description thereof.

The fuel injector 100 differs from the fuel injector 10 in that the valve 62 at he inlet 60 of the injector is omitted, in that the valve 74 carried by the piston 70 is simplified and re-positioned, and in that a narrow liquid passage 102 is provided in the upper housing 12*a*, the passage 102 leading to an opening in the surface 20 adjacent to its junction with its surface 22 (the groove 78 being omitted).

The omission of the valve 62 means that the ejector 100 does not draw fuel into its inlet 60 so that the inlet 60 has to be connected to a low-pressure pump to prevent liquid being pushed out of the inlet 60 when the piston 70 is moved upwardly and to ensure that the liquid passes through the passage 76 through the piston 70.

The re-positioning of the valve 74 is to a recess formed in the lower surface of the lower piston portion 70*b*. The passage 76 is, accordingly, extended upwardly to open through the upper surface of the upper piston portion 70*a*, ie in to the space 65. The valve 74 is also simplified to a simple ball valve (without a spring return), the ball being retained in the recess by a pin 104. The re-positioning of the valve 74 and the omission of the spring of the valve both act to reduce the dead volume of the injector 100.

The passage 102 in the upper housing portion 12*a* is to allow return of liquid to tank, this passage facilitating a continuous circulation of fuel to aid air-cooling of the injector 100 and removal of any air from the cavity 65.

What is claimed is:

1. A fuel injector which comprises a housing having an inlet for fuel from which fuel can be transferred into a cavity of the injector, at least one outlet orifice communicating with said cavity, a one-way valve carried by the housing operable to prevent fuel leaving the cavity other than by said outlet orifice, and ejecting means operable to reciprocate a piston within the housing, the piston having a force-applying end separated from the cavity by said one-way valve and a passage through the piston communicating with said force-applying end, said piston being operable in reciprocation to transfer fuel through said passage and to apply force to said transferred fuel by way of said force-applying end to cause transfer of said fuel into said cavity to be ejected through said orifice as discrete charges at predetermined intervals, said passage containing a one-way valve mounted adjacent to the force-applying end of the piston.

2. A fuel injector which comprises an inlet for fuel from which fuel can be transferred into a cavity of the injector, at least one outlet orifice communicating with said cavity, and ejecting means operable to apply force to fuel in said cavity to cause said fuel to be ejected through said orifice as discreet charges at predetermined intervals:

characterized in that the operation of said electing means is also operable to transfer fuel into said cavity, and said ejecting means is operable to move a piston to apply force to fuel in said cavity and said further fuel is transferred to said cavity through a passage through said piston, said passage containing a one-way valve.

3. A fuel injector according to claim 2, characterized in that said one-way valve Is mounted at a force-applying end of the piston.

4. A fuel injector according to claim 2, characterized in that the diameter of the force-applying-end of the piston has a small ratio to the stroke of the piston.

5. A fuel injector according to claim 2, characterized in that the movement of said piston is also effective to draw fuel in through said inlet.

6. A fuel injector according to claim 2, characterized in that the ejecting means comprises an electro-magnetic coil and at least a portion of the piston is made of soft-magnetic material.

7. A fuel injector according to claim 6, characterized in that the ejecting means also comprises a spring operable to move the piston in the opposite direction to the coil.

8. A fuel injector according to claim 7, characterized in that the coil is operable to move the piston to compress the spring and the spring is operable to move the piston to cause fuel to be ejected.

9. A fuel injector according to claim 1, characterized in that said cavity is bounded by a one-way valve.

10. A fuel injector according to claim 1, characterized in that the force-applying end of the piston has a diameter that is related to the stroke of the piston as a ratio in the range of 1:2 to 2:1.

11. A fuel injector according to claim 10, characterized in that the diameter of the force-applying end of the piston is smaller than the stroke of the piston.

12. A fuel injector according to claim 1, characterized in that the one-way valve contained in the passage comprises an unsprung valve arranged to be opened to a passage of fuel when the piston is at rest.

13. A fuel injector according to claim 12, characterized in that the one-way valve contained in the passage comprises a seat and a ball disposed between the seat and the force-applying end of the piston, the ball being arranged to be seated by displacement of the piston by the ejecting means towards the cavity.

14. A fuel injector, comprising:

a housing having an inlet, a cavity, and at least one outlet orifice communicating with said cavity;

a piston having a passage communicating with said inlet to receive fuel entering said fuel injector through said inlet, said passage extending through said piston and communicating with said cavity such that the fuel is transferred from said inlet to said cavity via said passage, said piston having a force-applying end adjacent said cavity;

a first one-way valve carried by said piston and being located adjacent said force-applying end such that the transferred fuel moving through said passage passes through said first one-way valve as it exits said piston; and a second one-way valve carried by said housing end being located between said piston and said cavity to prevent fuel leaving the cavity other than by said outlet orifice.

15. A fuel injector according to claim 14, wherein said cavity is bounded at an upper end by said second one-way valve and at a lower end by said outlet orifice.

* * * * *

UNITED STATES PATENT AND TRADEMARK OFFICE

CERTIFICATE OF CORRECTION

PATENT NO. : 6,871,800 B2
DATED : March 29, 2005
INVENTOR(S) : Tinwell et al.

It is certified that error appears in the above-identified patent and that said Letters Patent is hereby corrected as shown below:

Column 6,
Line 39, after "predetermined intervals" delete ":" and insert -- ; --.
Line 40, after "operation of said" delete "electing" and insert -- ejecting --.
Line 47, after "said one-way valve" delete "Is" and insert -- is --.

Column 8,
Line 13, after "by said housing" delete "end" and insert -- and --.

Signed and Sealed this

Third Day of January, 2006

JON W. DUDAS
*Director of the United States Patent and Trademark Office*